US009874125B2

(12) United States Patent
Nelson et al.

(10) Patent No.: US 9,874,125 B2
(45) Date of Patent: Jan. 23, 2018

(54) QUADRUPLE-TUNED SILENCER APPARATUS AND METHOD FOR ATTENUATING SOUND FROM AN ENGINE EXHAUST

(71) Applicant: MIRATECH GROUP, LLC, Tulsa, OK (US)

(72) Inventors: David Alan Nelson, Elgin, TX (US); Adam Merillat, Tulsa, OK (US); Casey Don Tevebaugh, Claremore, OK (US); Francis E. Reder, Tulsa, OK (US)

(73) Assignee: Miratech Group, LLC, Tulsa, OK (US)

( * ) Notice: Subject to any disclaimer, the term of this patent is extended or adjusted under 35 U.S.C. 154(b) by 141 days.

(21) Appl. No.: 14/051,224

(22) Filed: Oct. 10, 2013

(65) Prior Publication Data

US 2017/0145880 A1 May 25, 2017

(51) Int. Cl.
*F01N 1/06* (2006.01)
*F01N 1/00* (2006.01)

(52) U.S. Cl.
CPC ..... *F01N 1/00* (2013.01)

(58) Field of Classification Search
CPC .... F01N 1/089; F01N 3/2885; F01N 2490/02; F01N 2490/04; F01N 2490/08; F01N 1/10; F01N 2470/20; F01N 1/083; F01N 2490/155; F01N 2490/18; F01N 2310/02; F01N 2310/04; F01N 2310/14; F01N 2470/02; F01N 2470/04; F04B 53/004; F04C 29/06–29/068
See application file for complete search history.

(56) References Cited

U.S. PATENT DOCUMENTS

| | | | | |
|---|---|---|---|---|
| 1,844,104 A | | 5/1929 | Schnell | |
| 2,326,613 A | | 2/1942 | Bourne et al. | |
| 3,031,824 A | | 4/1958 | Court | |
| 3,642,095 A | | 2/1972 | Fujii | |
| 4,109,751 A | * | 8/1978 | Kabele | F01N 1/089 181/229 |
| 4,203,503 A | | 5/1980 | Franco et al. | |
| 4,209,076 A | * | 6/1980 | Franco et al. | 181/272 |
| 4,287,962 A | | 9/1981 | Ingard et al. | |

(Continued)

FOREIGN PATENT DOCUMENTS

| | | | | |
|---|---|---|---|---|
| DE | 1166970 B | * | 4/1964 | F01N 1/02 |
| DE | 1942084 A1 | * | 2/1971 | F01N 1/023 |

(Continued)

OTHER PUBLICATIONS

Barron, Randall F. Industrial Noise Control and Acoustics. New York: Marcel Dekker, 2003. Print. pp. 368-386.*

(Continued)

*Primary Examiner* — Jonathan Matthias
(74) *Attorney, Agent, or Firm* — Fredrikson & Byron, P.A.

(57) ABSTRACT

An apparatus and method for attenuating sound from an engine exhaust. The relative lengths of the expansion chambers and other components within the apparatus provide a quadruple tuning effect which attenuates sound over a wide frequency range. Attenuation at higher frequencies is also increased and extended by the use of acoustically lined internal baffle tubes inside the apparatus housing.

25 Claims, 4 Drawing Sheets

(56) References Cited

U.S. PATENT DOCUMENTS

| | | | | |
|---|---|---|---|---|
| 4,393,652 | A * | 7/1983 | Munro | F01N 1/10 181/243 |
| 5,457,290 | A | 10/1995 | Sase et al. | |
| 5,519,993 | A | 5/1996 | Rao et al. | |
| 6,334,506 | B1 | 1/2002 | Hamrin et al. | |
| 6,530,452 | B1 | 3/2003 | Pettersson et al. | |
| 2003/0155175 | A1 | 8/2003 | Kaku et al. | |
| 2005/0262835 | A1 | 12/2005 | Chrisman et al. | |
| 2008/0023265 | A1 | 1/2008 | Frederiksen et al. | |
| 2010/0192880 | A1 | 8/2010 | Koyanagi et al. | |
| 2013/0048416 | A1 * | 2/2013 | Pradhan | F01N 1/089 181/268 |
| 2013/0056299 | A1 | 3/2013 | Choi | |

FOREIGN PATENT DOCUMENTS

| | | | | |
|---|---|---|---|---|
| DE | 2527111 | A | 1/1976 | |
| FR | 2707341 | A1 | 1/1995 | |
| WO | WO 9321428 | A1 * | 10/1993 | F01N 1/065 |
| WO | WO99-50539 | A2 | 10/1999 | |

OTHER PUBLICATIONS

Machine translation of DE 1942084 A1, accessed on Feb. 17, 2016.*

Vér, I. L., and Leo L. Beranek. Noise and Vibration Control Engineering: Principles and Applications. Hoboken, NJ: Wiley, 2006. Print.*

Munjal, M. L. Noise and Vibration Control. Singapore: World Scientific, 2013. Print.*

Machine translation of DE 1166970 B, accessed Dec. 12, 2016.*

MIRATECH; "Housings RCS/RHS Catayst-Silencer"; Publication—Internet; Feb. 2012; Published in: US.

MIRATECH; "Emissions Monitor"; Publication—Internet; Sep. 2012; Published in: US.

International Search Report and Written Opinion for International Application No. PCT/US2014/060003, dated Jan. 27, 2015, 14 pages.

* cited by examiner

QUADRUPLE-TUNED SILENCER APPARATUS AND METHOD FOR ATTENUATING SOUND FROM AN ENGINE EXHAUST

FIELD OF THE INVENTION

The present invention relates to exhaust muffler apparatuses and methods for industrial engines. The invention also relates to engine exhaust muffling apparatuses and methods which include catalytic converters for removing pollutants from the exhaust stream.

BACKGROUND OF THE INVENTION

Exhaust mufflers for large stationary industrial engines are typically designed with reactive and/or dissipative components. Reactive components function by creating a mismatch in acoustic impedance that causes a portion of an acoustic wave to be reflected. The impedance mismatch is typically created by a sudden area change (either an expansion or contraction) in the muffler chamber. When the acoustic wave is reflected, the reflected wave interferes with the incoming wave in accordance with the law of superposition and can thereby "cancel out" a portion of the sound energy.

Dissipative components, on the other hand, employ sound absorbing materials which function by converting acoustic energy into heat energy. Their performance is dependent upon the thickness, density, flow resistivity, and length of the sound absorbing material in the flow path.

Heretofore, for a given engine exhaust pipe diameter, the techniques used in the art for improving the performance of an exhaust muffler in a large industrial application have typically involved increasing the length of the muffler housing and adding additional interior chambers. However, this approach becomes very costly as the length and complexity of the muffler increase. Further, as the length of the muffler unit increases, the muffler takes up more and more space which could be used for other purposes, or which may not be available without moving or modifying other equipment. Moreover, the current technique of simply increasing the length of the muffler and adding additional chambers often does not provide the degree of sound attenuation needed.

A need therefore exists for an improved exhaust muffler for industrial engines which: (a) provides better performance than existing systems over a wider range of frequencies; (b) is of significantly reduced length; (c) is readily adaptable for use with engines of increasing size without significantly increasing the length of the muffler housing; (d) allows the production of more standardized muffler units which can each be used for a range of different engines in a variety of applications; and (e) is less costly and simpler to build, install and maintain.

SUMMARY OF THE INVENTION

The present invention provides an apparatus and method for attenuating engine exhaust sound which address the needs and alleviate the problems discussed above. The inventive sound attenuating apparatus preferably comprises a quadruple-tuned muffler, or a combination muffler and catalytic converter assembly, which is capable of providing (a) a transmission loss of 60 dB(A) or more over the 31.5 to 8000 Hz octave bands and (b) a flange to flange pressure loss of less than 6.0 inches $H_2O$ gage.

The inventive apparatus and method are well suited for use with industrial or other large combustion engines such as, for example, 2-stroke or 4-stroke reciprocating (piston) internal combustion engines and non-reciprocating engines such as turbine engines. Moreover, because the lengths of the chambers and components within the inventive apparatus will be determined primarily by the operating speed (rpm) of the engine rather than its size, it is not necessary that the inventive apparatus be made progressively longer in order to achieve additional attenuation for larger engines which operate at the same speed.

In one aspect, there is provided an apparatus for attenuating sound from an engine exhaust wherein the apparatus comprises a housing having an exhaust flow path traveling therethrough and a series of components in the exhaust flow path. Two or more of the components have relative lengths which preferably tune the apparatus to attenuate sound over a frequency range which (a) begins at least at, and includes at least a portion of, a lower octave band having a center frequency of 31.5 Hz and (b) extends at least to, and includes at least a portion of, an upper octave band having a center frequency of 8000 Hz. The components in the exhaust flow path preferably comprise: an exhaust gas inlet for the housing; an exhaust gas outlet for the housing; a first expansion chamber within the housing which is downstream of the exhaust gas inlet in the exhaust flow path; a second expansion chamber within the housing which is positioned downstream of the first expansion chamber within the housing in the exhaust flow path; and one or more internal baffle tubes in the housing, each of the internal baffle tubes having a downstream portion which extends into the second expansion chamber.

It is also preferred that each of the said one or more internal baffle tubes having a downstream portion extending into the second expansion chamber comprise: (a) a longitudinally extending outer wall surrounding an open longitudinal flow passageway extending through the internal baffle tube and (b) an acoustic lining which is provided on the inner surface of the longitudinally extending outer wall such that the acoustic lining surrounds the open longitudinal flow passageway extending through the internal baffle tube.

In another aspect, there is provided an apparatus for attenuating sound from an engine exhaust comprising: a housing having an exhaust gas inlet and an exhaust gas outlet; an exhaust gas flow path traveling through the housing from the exhaust gas inlet to the exhaust gas outlet; a first expansion chamber in the exhaust gas flow path within the housing; a second expansion chamber in the exhaust gas flow path within the housing, the second expansion chamber being positioned in the exhaust gas flow path downstream of the first expansion chamber; and one or more internal baffle tubes positioned inside the housing in the exhaust gas flow path, each of the one or more internal baffle tubes having a downstream portion which extends into the second expansion chamber. Preferably, the longitudinal length of the first expansion chamber is equal to or approximately equal to ¼ of the longitudinal length of the second expansion chamber.

In another aspect, there is provided a method for attenuating sound from an exhaust stream from an engine comprising the step of delivering the exhaust stream through a sound attenuating apparatus. The sound attenuating apparatus preferably comprises: a housing having an exhaust gas inlet and an exhaust gas outlet; an exhaust gas flow path traveling through the housing from the exhaust gas inlet to the exhaust gas outlet; a first expansion chamber in the housing, the first expansion chamber being in the exhaust gas flow path and the first expansion chamber having a longitudinal length; a second expansion chamber in the housing, the second expansion chamber being downstream of the first expansion chamber in the exhaust gas flow path and the second expansion chamber having a longitudinal length which is equal to or approximately equal to four times the longitudinal length of the first expansion chamber; and one or more internal baffle tubes in the exhaust gas flow path within the housing, each of the one or more internal baffle tubes having a downstream portion which extends into the second expansion chamber.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
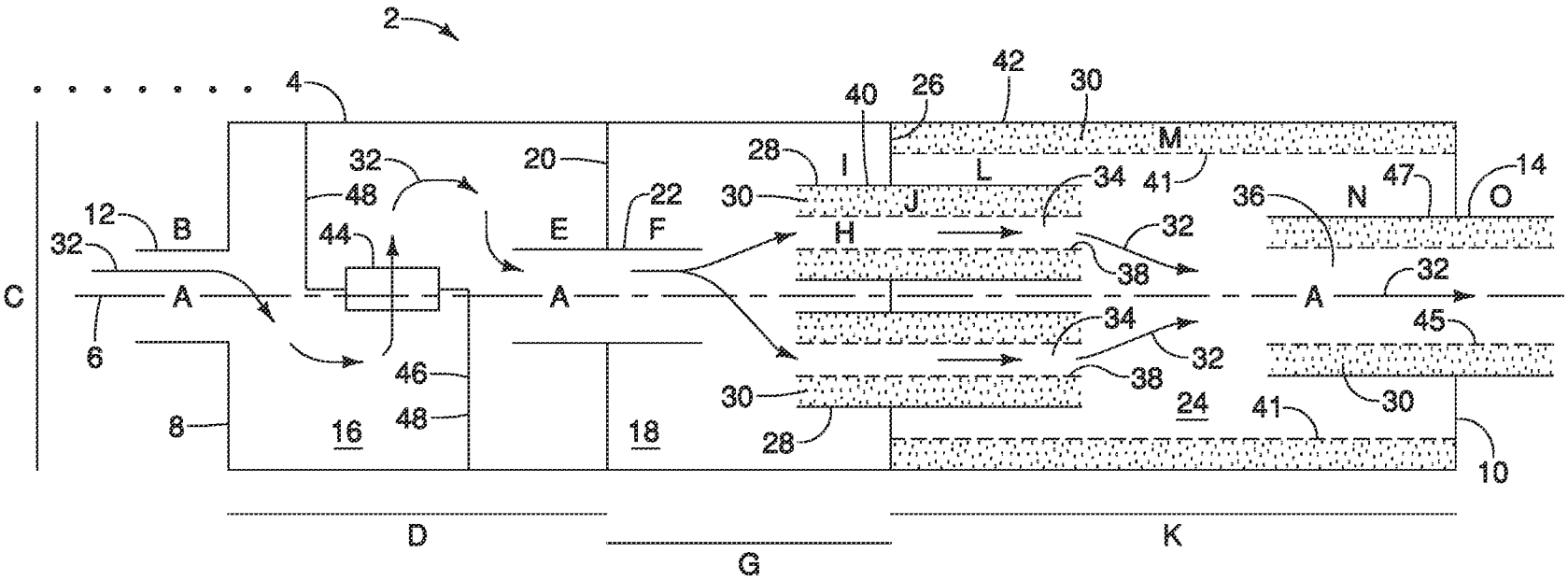
FIG. 1 schematically illustrates a cut-away elevational side view of an embodiment 2 of the apparatus provided by the present invention for attenuating the sound of an engine exhaust.

An embodiment 2 of the inventive sound attenuating apparatus is illustrated in FIG. 1. The inventive apparatus 2 is a combination muffler and catalytic converter assembly comprising: (a) an outer housing 4 having a longitudinal axis 6, an inlet end 8, and an outlet end 10; (b) an outwardly extending exhaust gas inlet 12 at the inlet end of the housing for connection to an engine tailpipe or other engine exhaust discharge conduit (not shown); (c) an exhaust outlet baffle tube 14 extending through the outlet end 10 of the housing 4; (d) a catalyst chamber 16 formed within the inlet end portion of the housing 4; (e) a first stage expansion chamber 18 formed within the housing 4 downstream of the catalyst chamber 16; (f) a bulkhead 20 within the housing 4 which separates the first expansion chamber 18 from the catalyst chamber 16; (g) one or more first stage baffle tubes 22 extending through the bulkhead 20 between the catalyst chamber 16 and the first expansion chamber 18; (h) a second stage expansion chamber 24 which is formed in the outlet end portion of the housing 4 downstream of the first expansion chamber 18; (i) a bulkhead 26 within the housing 4 which separates the second expansion chamber 24 from the first expansion chamber 18; and (j) one or more (preferably a plurality of and most preferably four) internal baffle tubes 28 extending through the bulkhead 26 between the first expansion chamber 18 and the second expansion chamber 24.

The inventive sound attenuating muffler apparatus 2 further comprises an acoustic lining material 30 which is preferably installed in the form of an annular ring around the internal surface of each of the internal baffle tubes 28, as well around the internal surfaces of the second expansion chamber 24 and the exhaust outlet baffle tube 14. Perforated inner tubes 38, 41, and 45 are also preferably provided within the internal baffle tubes 28, the second expansion chamber 24, and the outlet baffle tube 14 which cover the inner surface of the lining material 30 and protect the lining material 30 from erosion due to flow.

As the exhaust gas from the engine is delivered through the inlet 12 of the housing, it travels along an exhaust gas flow path 32 which sequentially takes the exhaust gas through the catalyst chamber 16, the first stage baffle tube(s) 22, the first stage expansion chamber 18, the internal baffle tube(s) 28, the second stage expansion chamber 24, and the exhaust outlet baffle tube 14. Consequently, as positioned in the exhaust gas flow path 32, the first stage expansion chamber 18 is downstream of the catalyst chamber 16 and the second stage expansion chamber 24 is downstream of the first stage expansion chamber 18.

Although the embodiment 2 of the inventive apparatus illustrated in FIG. 1 is cylindrical, it will be understood that the inventive apparatus 2, including the inlet 12, the housing 4, the first stage baffle tube(s) 22, the internal baffle tubes 28, and/or the outlet 14 of the apparatus 2, can alternatively be rectangular or have any other desired cross-sectional shape. By way of example, one factor which may be of significance in selecting the cross-sectional shape of the inventive apparatus 2 would be the cross-sectional shape of the engine exhaust.

In the inventive muffler apparatus 2, the lengths of the various components (i.e., the inlet 12, outlet 14, expansion chambers 18 and 24, etc.) in the flow path 32 are preferably determined based upon the shaft rate (rpm) of the engine in order to tune the inventive muffler apparatus 2 to cover the frequency range desired. Because the lengths are determined from the shaft rate, the same methodology can be applied to 2 or 4 stroke reciprocating internal combustion engines, as well as to non-reciprocating engines such as turbine engines. Similarly, the diameters or cross-sectional flow areas of the housing 4 and the components (i.e., the inlet 12, outlet 14, expansion chambers 18 and 24, baffle tubes 22 and 28, etc.) in the flow path 32, are preferably determined based upon the diameter or cross-sectional flow area of the engine tailpipe in order to control (a) the amount of attenuation provided for the effective frequency range of the apparatus and (b) the amount of pressure drop which occurs across the inventive apparatus 2.

Concerning the speed of the industrial engine in revolutions per minute (rpm), those in the art are aware that an industrial engine will have a maximum operating speed, defined by the manufacturer. However, the driven device coupled to the engine will also have a maximum operating speed, or a range of operating speeds, which may be less than the maximum available operating speed of the engine. Consequently, the actual operating speed (or range of speeds) for a given engine will be site-specific to the application in question.

For purposes of this invention, when using the operating speed of an engine for determining the length or any other dimensions or characteristics of the components of the inventive muffler apparatus 2, the operating speed value used will preferably be the minimum speed (rpm) at which the engine will be operated.

Related to the rpm of an engine, it will also be understood that, as used herein and in the claims, unless otherwise specified, the output shaft rate Fundamental Frequency ($f_0$) of the engine will be the value determined using the following equation:

$$f_0=(\text{rpm})/60$$

Also, as used herein and in the claims, unless otherwise specified, the output shaft rate Fundamental Wavelength ($\lambda_0$) of the engine will be the value determined using the following equation:

$$\lambda_0 = C/f_0$$

wherein $C$=The speed of sound in the medium=20.047 $(273.15+T_E)^{1/2}$ $T_E$=The engine exhaust temperature (° C.)

In contrast to the mufflers previously used in the art, the relative lengths of various components of the inventive apparatus 2 are preferably selected to provide a quadruple-tuned expansion chamber. To provide the inventive quadruple-tuning effect, the system components of primary interest will in most cases include: (1) the first stage expansion chamber 18; (2) the second stage expansion chamber 24; (3) the downstream length F of the first stage baffle tube(s) 22 which extends into the first expansion chamber 18; the internal baffle tube(s) 28, and (4) the upstream length N of the housing outlet baffle tube 14 which extends into the second expansion chamber 24.

Consequently, the quadruple-tuned expansion chamber is formed of an upstream double-tuned expansion chamber and a downstream double-tuned expansion chamber wherein (a) the first double-tuned expansion chamber comprises the first stage expansion chamber 18 with the added effects of the downstream length F of the first stage baffle tube(s) 22 and the upstream length I of the internal baffle tube(s) 28 which expand the frequency range of the first double-tuned chamber as compared to an otherwise empty chamber and (b) the second double-tuned expansion chamber comprises the second stage expansion chamber 24 with the added effects of the downstream length L of the internal baffle tube(s) 28 and the upstream length N of the housing outlet baffle tube 14 which expand the frequency range of the second double-tuned chamber as compared to an empty chamber.

In addition, in the inventive apparatus 2, the longitudinal length K of the downstream second stage expansion chamber 24 is most preferably four times, or approximately 4 times, the longitudinal length G of the upstream first stage expansion chamber 16. Also, the length L to which the internal baffle tube(s) 28 extend forwardly into the second expansion chamber 24 will preferably be four times, or approximately four times, the length F which the first stage baffle tube(s) extend forwardly into the first expansion chamber 18. Further, the length N to which the outlet baffle tube 14 extends rearwardly into the second expansion chamber 24 will preferably be four times, or approximately four times, the length I to which the internal baffle tube(s) 28 extend rearwardly into the first expansion chamber 18.

The use of the 4:1 expansion chamber ratio and the 4:1 baffle tube forward segment and rearward segment ratios described above in the inventive apparatus 2 produces a synergistic effect whereby the two double-tuned expansion chambers operate together in the inventive quadruple-tuned system to provide a total reactive sound cancelling octave range extending over, or approximately over, twice the frequency range of one double-tuned expansion chamber.

In addition, the preferred 4:1 length ratio of the inventive quadruple-tuned system operates to "smooth out" the reactive attenuation curve of the inventive apparatus 2 over the quadruple-tuned frequency range. That is to say, if the attenuation of a particular frequency is weak in one chamber, this will be counteracted by a stronger attenuation at the same frequency in the other chamber.

The inventive quadruple-tuned muffler apparatus 2 therefore provides effective reactive attenuation over the frequency range of interest. Moreover, when the dissipative attenuation benefit provided by the internal acoustic lining 30 (discussed below) is added, the inventive apparatus 2 can provide further attenuation for the higher frequencies.

As used herein and in the claims, unless otherwise stated, the terms "approximately" or "about" in reference to any dimension or amount pertaining to the inventive apparatus or method includes any value which is within ±10% of the stated dimension or amount.

Depending on the amount of sound attenuation needed for a particular application, the actual of effective internal diameter C of the housing 4 of the inventive muffler apparatus 2 can be of any size desired, ranging from very small to very large. Because increasingly large ratios of chamber cross-sectional area to inlet cross-sectional area result in greater attenuation, very large diameters (relative to the inlet) can achieve more performance. In order to meet the 60 dB(A) attenuation design goal with a minimum amount of material/cost, generally, for engines having a tailpipe diameter (if cylindrical) of A, or an effective tailpipe diameter of A if non-cylindrical, of less than 10 inches, the housing 4 of the inventive muffler apparatus 2 will preferably have an actual internal diameter or effective internal diameter C of at least about (2.5(A−10)+40) inches. More preferably, when A is less than 10 inches, the actual or effective internal diameter C will be in the range of from about (2.0(A−10)+50) to about (2.5(A−10)+40) inches and will most preferably be equal to (2.3(A−10)+x) wherein x is a value in the range of from about 40 to about 50. For more or less attenuation, a greater or lesser value for C may be used.

For engines having a tailpipe diameter or effective diameter A of 10 inches or more, in order to meet the 60 dB(A) attenuation design goal with a minimum amount of material/cost, the diameter or effective diameter C of the housing 4 will preferably be at least about (2.0(A−10)+40) inches. More preferably, when A is 10 inches or more, the actual or effective diameter C will be in the range of from about (2.0(A−10)+40) to about (2.5(A−10)+45) inches and will more preferably be equal to (2.3(A−10)+y) wherein y is a value in the range of from about 40 to about 45. For more or less attenuation, a greater or lesser value for C may be used.

By way of example, for engines having an rpm of from 1000 to 1400 and a tailpipe diameter or effective diameter A of 10 inches or more, the diameter or effective diameter C of the of the housing 4 will most preferably be equal to or approximately equal to C=2.3(A−10)+40.2. For engines having an rpm of about 750 and a tailpipe diameter or effective diameter A of 10 inches or more, the diameter or effective diameter C of the of the housing 4 will most preferably be equal to or approximately equal to C=2.3(A−10)+44.8.

As used herein and in the claims, when it is stated, for example, that a particular cross-section, combination of cross-sections, or object "has an effective diameter A", it is meant that that the cross-section or other object in question has a size (i.e., an area) which is equal to the area of a circle having a diameter of A. Also, in each of the following calculations, it is assumed that the tailpipe or other exhaust conduit of the engine connected to the inventive muffler apparatus 2 has a diameter or effective diameter of A inches.

Further, since the inlet 12 or 112 of the inventive apparatus 2 or 102 selected for a given application will preferably also have an internal diameter or effective diameter which matches or is close to the diameter or effective diameter A of the engine exhaust, references appearing herein and in the claims to the diameter A or effective diameter A are used interchangeably to refer to either (a) the internal diameter, or effective diameter, of the engine exhaust or (b) the diameter, or effective diameter, of the exhaust gas inlet 12 or 112 of the inventive apparatus 2 or 102.

The length B of the exhaust gas inlet 12 is preferably equal to or approximately equal to 0.4 times A.

The preferred longitudinal length D of the catalyst chamber 16 can vary depending upon the flow criteria and path of the catalyst used in chamber 16. However, the length D of the catalyst chamber 16 will typically be equal to, approximately equal to, or close to 4 times A.

The first stage baffle tube(s) 22 connecting the catalyst chamber 16 and the first stage expansion chamber 18 will preferably comprise either a single tube having an actual or effective diameter which is equal to or approximately equal to A or a plurality of tubes having a total combined effective diameter which is equal to or approximately equal to A. Each first stage baffle tube 22 will preferably extend into the catalyst chamber 16 a distance E which is equal to or approximately equal to ¼ of the longitudinal length G of the first expansion chamber 18 and will also preferably extend the same distance F into the first stage expansion chamber 18.

The longitudinal length G of the double-tuned first stage expansion chamber 18 will preferably be equal to or approximately equal to ¼ of the longitudinal length K of the second double-tuned expansion chamber 24.

The longitudinal length K of the second double-tuned expansion chamber 24 will preferably be at least 1.6 times the length D of the catalyst chamber 16 and will more preferably be from about 1.75 to about 4 times the length D of the catalyst chamber 16.

Alternatively or in addition, the longitudinal length K of the second expansion chamber 24 will most preferably be equal to or approximately equal to $((\lambda_0/2)*\Theta)$ wherein $\Theta$ is a value in the range of from about 6 to about 7.5. For an engine speed of from 1000 to 1400 rpm, $\Theta$ is most preferably about 6.5. For an engine speed of 750 rpm, $\Theta$ is most preferably a value of about 7.

In each of the one or more internal baffle tube(s) 28 connecting the first expansion chamber 18 and the second stage expansion chamber 24, the acoustic lining 30 and the inner perforated tube wall 38 within the tube 28 surround an open, longitudinally extending flow area 34. The internal baffle tube(s) 28 will preferably comprise either (1) a single baffle tube 28 wherein the actual or effective diameter H of the open flow area 34 extending therethrough is greater than A or (2) a plurality of (most preferably four) internal baffle tubes 28 wherein the effective diameter of the total combined open areas extended through the tubes 28 is greater than A. The diameter or the effective total diameter H of the open flow area(s) 34 of the internal baffle tube(s) 28 can be chosen to optimize pressure drop concerns, but is preferably in the range of from about 10% to about 20% greater than A and is most preferably about 14% greater than A.

Each internal baffle tube 28 will preferably extend into the first expansion chamber 18 a distance I which is equal to or approximately equal to one-half of the longitudinal length G of the first stage expansion chamber 18 and will preferably also extend into the second expansion chamber 24 a distance L which is equal or approximately equal to the longitudinal length G of the first stage expansion chamber 18.

In the outlet baffle tube 14 of the inventive apparatus 2, the acoustic lining 30 and the inner perforated tube wall 45 surround a longitudinally extending open flow area 36 which preferably has an actual diameter or effective diameter which is equal to or approximately equal to the diameter or effective diameter A of the engine tailpipe (or the exhaust gas inlet 12). The outlet baffle tube 14 will preferably extend into the second expansion chamber 24 a distance N which is two times or approximately two times the longitudinal length G of the first stage expansion chamber 18 and will extend out of the housing 4 a distance O which is preferably equal to or approximately equal to one-half of the diameter or effective diameter A of the engine tailpipe.

The novel use of the acoustic lining material 30 in the internal baffle tube(s) 28, as well as in the second stage expansion chamber 24 and in the outlet baffle tube 14, provides significant additional benefits and advantages for the inventive muffler.

To our knowledge, internal baffle tubes within the housing of a muffler have not been lined heretofore. Lining the internal baffle tube(s) 28 within the housing 4 is a novel way to integrate acoustic lining into the inventive muffler without adding an entirely separate lined section to the muffler, which would increase the overall length and cost of the unit. Additionally, since the amount of dissipative attenuation provided by the acoustic lining is mostly dependent upon the length of lining, the length of lined internal baffle tube used in the present invention provides almost the same amount of attenuation as a length of lined shell. However, because of its smaller diameter, a baffle tube can be lined using much less material.

Further, because the cross-sectional flow area through a lined baffle tube is much smaller then the cross-sectional flow area of a lined chamber, the occurrence of "beaming", in which small wavelength sound passes through a lined section without touching the lining, is significantly reduced in a lined baffle tube versus a lined chamber.

In addition, the preferred use of acoustically lined internal baffle tubes 28 in accordance with the present invention significantly increases the amount of attenuation which occurs in the baffle tubes 28 and in the apparatus 2 as a whole. Acoustically, an unlined baffle tube is a purely reactive component. Therefore, the use of an unlined baffle tube in the inventive apparatus, although encompassed within the present invention, would provide attenuation over a smaller range of discrete frequencies. Acoustic lining, on the other hand, is a dissipative component and provides significant additional attenuation over a much wider range of frequencies.

The acoustic lining material 30 can be essentially any acoustic material that is effective for attenuating sound and which will withstand the temperature conditions and the exhaust environment within the inventive muffler apparatus 2. The acoustic lining material 30 will preferably have a sound absorption coefficient of at least 0.99 for frequencies in the 500 to 8000 Hz octave bands and a flow resistivity which is preferably in the range of from about 10,000 to about 15,000 rayls/m and is most preferably about 13,100 rayls per meter at standard temperature and pressure.

Examples of acoustic lining materials preferred for use in the inventive apparatus 2 include, but are not limited to, mineral fiber, fiberglass, continuously woven fiber, metamaterials, metal wool, expanding foam, steel wool, similar materials, or combinations thereof. The thickness of the acoustic liner 30 used in the inventive apparatus 2 will preferably be equal to or approximately equal to 2 inches.

As noted above, in each of (a) the internal baffle tube(s) 28, (b) the outlet baffle 14, and (c) the second stage expansion chamber 24, a longitudinally extending inner perforated tube wall 38, 41, 45 is preferably provided so that the acoustic liner 30 is sandwiched between the outer wall 40, 42, 47 and the inner perforated wall 38, 41, 45 of the baffle tube or chamber. Consequently, in this arrangement, the longitudinally extending perforated inner walls 38, 40, 45 are positioned inside the acoustic lining 30 and surround both (1) the open longitudinal flow passages 34, 36 extending through the baffle tube 28, 14 and (2) the interior of the expansion chamber 24.

As also illustrated in FIG. 1, we have further discovered that the one or more catalytic converter catalyst elements 44 used in the catalyst chamber 16, as well as the bulkheads 48 forming the catalyst frame assembly 46 in chamber 16 for holding and removably inserting the catalyst element(s) 44, will preferably create one or more, most preferably two, 90° turns in the exhaust gas flow path 32 as the exhaust gas flows through the catalyst elements 44. Examples of such catalytic converter arrangements include the Model ZXS assembly available from MIRATECH.

As opposed to catalyst elements of the type wherein the exhaust gas flows essentially straight through the system, we have discovered that forcing the exhaust gas to make 90° (or approximately 90°) turns through the catalyst element(s) 44 adds significant additional mid frequency attenuation to the inventive muffler apparatus 2.

FIG. 1 illustrates the use of a single catalyst element 44 in the catalyst chamber 16 wherein the catalyst element 44 is positioned in a side-ways orientation and the frame bulkheads 48 which hold the catalyst element 44 create two 90° turns in the exhaust gas flow path 32.

Figure 2:
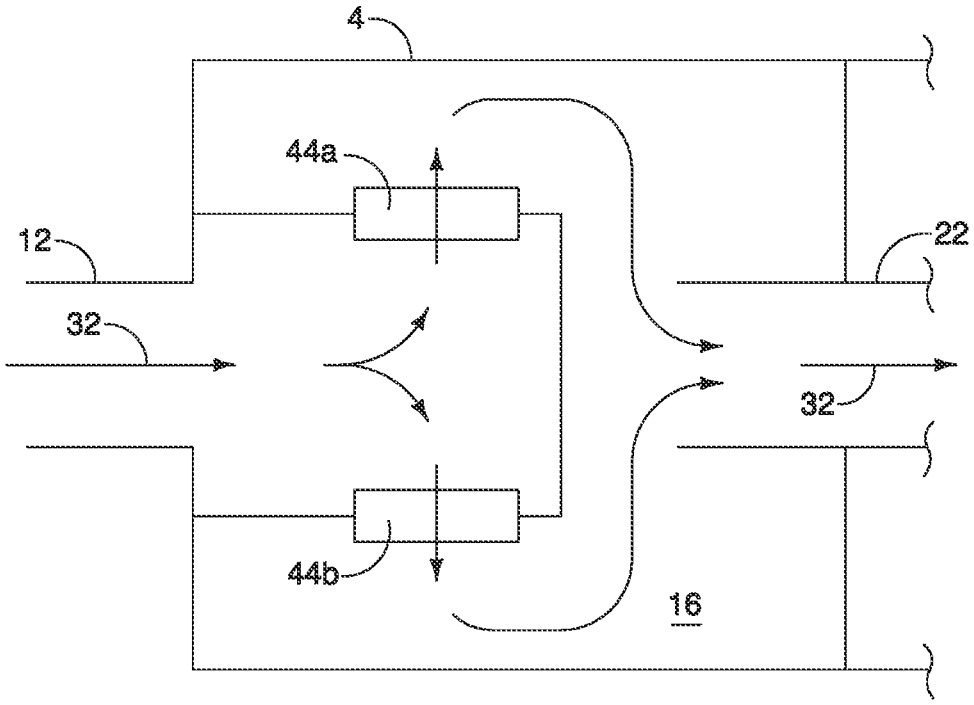
FIG. 2 is a cut-away elevational sectional view which schematically illustrates an alternative catalyst arrangement within the catalyst chamber 16 of the inventive apparatus 2 illustrated in FIG. 1.

FIG. 2 is a sectional view of the catalyst chamber 16 showing an alternative arrangement using two catalyst elements 44*a* and 44*b* in the catalyst chamber 16 which operate in parallel such that one half of the exhaust gas flow makes two 90° turns through element 44*a* and the other half of the exhaust flow makes two 90° turns through element 44*b*.

Figure 3:
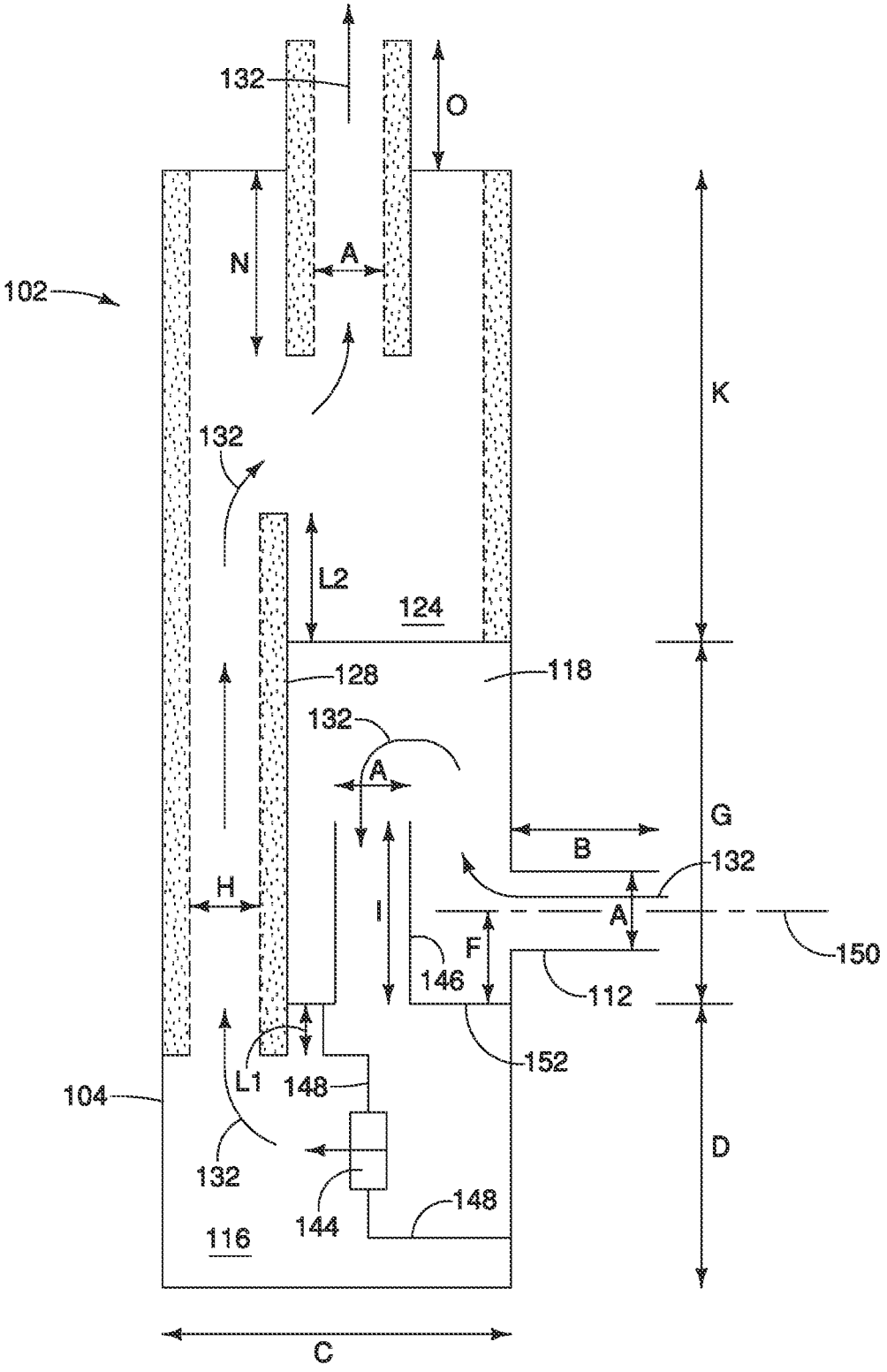
FIG. 3 schematically illustrates a cut-away elevational front view of an alternative embodiment 102 of the inventive apparatus for attenuating the sound of an engine exhaust.

An alternative embodiment 102 of an inventive quadruple-tuned, combination muffler and catalytic converter apparatus is illustrated in FIG. 3. The inventive apparatus 102 is configured such that the unit can be vertically mounted but will still allow ground access to the catalytic converter element(s) 144 in the catalyst chamber 116.

In the inventive muffler apparatus 102, the chambers of the apparatus are positioned in the vertical apparatus housing 104 such that the catalyst chamber 116 is located in the bottom of the housing 104, the first stage expansion chamber 118 is above the catalyst chamber 116, and the second stage expansion chamber 124 is above the first expansion chamber 118. This is similar to the arrangement within the inventive apparatus 2 of FIG. 1 except that, in the inventive apparatus 102, in addition to being vertically mountable, (a) the exhaust gas inlet 112 for the housing 104 of the inventive apparatus 102 extends outwardly from the vertical side wall of the housing 104 and is a direct inlet for the first expansion chamber 118, (b) the exhaust gas flow path 132 created in the housing 104 of the inventive apparatus 102 travels through the first expansion chamber 118 prior to traveling through the catalyst chamber 116, (c) one or more flow baffle(s) 146 is/are provided to direct the exhaust gas flow path 132 from the first expansion chamber 118 to the catalyst chamber 116, and (d) the internal baffle tube(s) 128 of the apparatus 102 extend longitudinally all of the way through the first expansion chamber 118 to the second stage expansion chamber 124 for delivering the exhaust gas from the catalyst chamber 116 to the second expansion chamber 124.

The lengths and diameters, or effective diameters, of the housing 104, the exhaust gas inlet 112, the first stage expansion chamber 118, the catalyst chamber 116, the lined second stage expansion chamber 124, and the lined exhaust gas outlet baffle tube 114 of the inventive apparatus 102 are preferably determined in the same manner as the corresponding components of the inventive apparatus 2 described above. The diameter or effective diameter of the total open flow area 134 through the lined internal baffle tube(s) 128 will also preferably be determined in the same manner as for the lined internal baffle tube(s) 28 of apparatus 2.

The one or more flow baffle(s) 146 for flow from the first expansion chamber 118 to the catalyst chamber 116 preferably has/have an actual diameter (i.e., in the case of a single cylindrical flow baffle 146) or a total effective diameter A which is equal or approximately equal to the diameter or effective diameter A of the engine exhaust conduit (or the diameter A of the exhaust gas inlet 112 of the apparatus 102). In addition, each of the one or more flow baffle(s) 146 preferably extends into the first expansion chamber 118 a distance I which is equal to or approximately equal to ⅛ of the longitudinal length K of the second expansion chamber 124.

Each of the one or more internal baffle tubes 128 inside the inventive apparatus 102 extends into the catalyst chamber 116 a distance L1 and extends into the second stage expansion chamber 124 a distance L2. The distance L1 is preferably equal to or approximately equal to 1/12 of the longitudinal length K of the second expansion chamber 124. The distance L2 is preferably equal to or approximately equal to ¼ of the longitudinal length K of the second expansion chamber 124.

In contrast to the double-tuned first expansion chamber 16 of the inventive silencer apparatus 2 shown in FIG. 1, the side inlet 112 of the first expansion chamber 118 of the inventive vertical apparatus 102 does not extend into expansion chamber 118 a distance F. However, the same double-tuning effect is achieved for the expansion chamber 118 by spacing the centerline 150 of the side inlet 112 a distance F from the outlet end bulkhead 152 of the chamber 118.

FIG. 3 illustrates the use of a single catalyst element 144 in the catalyst chamber 116 wherein the catalyst element 144 is positioned in a side-ways orientation and the frame bulkheads 148 which hold the catalyst element 144 create two 90° (or approximately 90°) turns in the exhaust gas flow path 132 through the catalyst 144.

Figure 4:
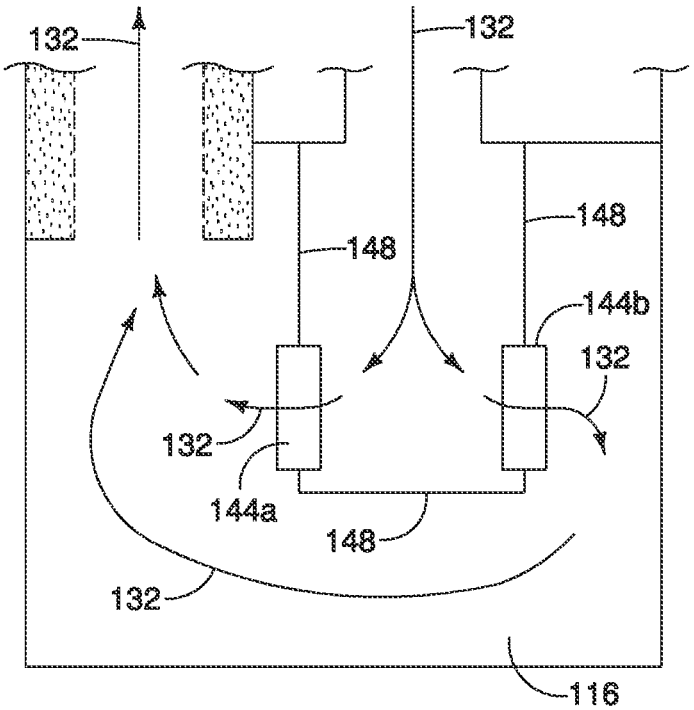
FIG. 4 is a cut-away elevational sectional view which schematically illustrates an alternative catalyst arrangement within the catalyst chamber 116 of the inventive apparatus 102 illustrated in FIG. 3.

FIG. 4 is a sectional view of the catalyst chamber 116 showing an alternative arrangement using two catalyst elements 144*a* and 144*b* in the catalyst chamber 116 which operate in parallel such that one half of the exhaust gas flow makes two 90° turns through the element 144*a* and the other half of the exhaust flow makes two 90° turns through the element 144*b*.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the invention as defined by the claims.

What is claimed is:

1. An apparatus for attenuating sound from an engine exhaust comprising:

a housing having an exhaust gas inlet and an exhaust gas outlet;

an exhaust flow path traveling through said housing from said exhaust gas inlet to said exhaust gas outlet;

a first expansion chamber within said housing which is downstream of said exhaust gas inlet in said exhaust flow path, said first expansion chamber having a longitudinal length;

a second expansion chamber within said housing which is downstream of said first expansion chamber in said exhaust flow path, said second expansion chamber having a longitudinal length, wherein said longitudinal length of said second expansion chamber is approximately four times said longitudinal length of said first expansion chamber;

a bulkhead separating said first expansion chamber from said second expansion chamber, said bulkhead having one or more openings extending through said bulkhead from said first expansion chamber to said second expansion chamber;

one or more internal baffle tubes located in said housing in said exhaust gas flow path, said one or more internal baffle tubes each having a longitudinally extending outer wall extending through said one or more openings of said bulkhead, said longitudinally extending outer wall having an inner surface, an acoustic lining located on said inner surface, said acoustic lining extending through said one or more openings of said bulkhead, and a longitudinally extending perforated inner wall that is positioned inside said acoustic lining, said longitudinally extending perforated inner wall surrounding an open longitudinal flow passageway extending through said internal baffle tube, wherein said one or more internal baffle tubes extend a first distance into said first expansion chamber and a second distance into said second expansion chamber;

a first stage baffle tube extending a third distance into said first expansion chamber, wherein said second distance is approximately four times said third distance; and an outlet baffle tube extending a fourth distance into said second expansion chamber and through said exhaust gas outlet, wherein said fourth distance is approximately four times said first distance.

2. The apparatus of claim 1 wherein:

said exhaust gas inlet of said housing is an outwardly extending inlet having a cross-sectional flow area, and said outlet baffle tube having an interior open cross-sectional flow area which is approximately equal to said cross-sectional flow area of said exhaust gas inlet.

3. The apparatus of claim 1 wherein:

said exhaust gas inlet has a cross-sectional flow area which is equal to an area of a circle having a diameter A;

at least a portion of a cross-sectional area of each of said one or more internal baffle tubes is an open cross-sectional area; and said one or more internal baffle tubes have a total combined open cross-sectional area which is equal to an area of a circle having a diameter which is in a range of from about 10% to about 20% greater than A.

4. The apparatus of claim 1 wherein said acoustic lining located on said inner surface of said one or more internal baffle tubes and said acoustic lining of said outlet baffle tube has a sound absorption coefficient of at least 0.99 for frequencies in octave bands extending from a 500 Hz octave band to an 8000 Hz octave band and a flow resistivity in a range of from about 10,000 to 15,000 rayls per meter at standard temperature and pressure.

5. The apparatus of claim 1 wherein said acoustic lining located on said inner surface of said one or more internal baffle tubes and said acoustic lining of said outlet baffle tube is formed of mineral fiber, fiberglass, continuously woven fiber, meta-material, metal wool, expanding foam, or steel wool.

6. The apparatus of claim 1 further comprising a catalyst chamber within said housing.

7. The apparatus of claim 6 further comprising a catalyst in said catalyst chamber in said exhaust flow path, wherein said exhaust flow path makes two turns of approximately 90° as said exhaust flow path travels through said catalyst chamber.

8. The apparatus of claim 6 wherein:

said catalyst chamber is positioned in said exhaust flow path upstream of said first expansion chamber;

and wherein the first stage baffle tube extends a fourth distance into said catalyst chamber.

9. An apparatus for attenuating sound from an engine exhaust comprising:

a housing having an exhaust gas inlet and an exhaust gas outlet;

an exhaust gas flow path traveling through said housing from said exhaust gas inlet to said exhaust gas outlet;

a first expansion chamber in said exhaust gas flow path within said housing, said first expansion chamber having a longitudinal length;

a second expansion chamber in said exhaust gas flow path within said housing, said second expansion chamber being positioned in said exhaust gas flow path downstream of said first expansion chamber and said second expansion chamber having a longitudinal length, wherein said longitudinal length of said second expansion chamber is approximately four times said longitudinal length of said first expansion chamber;

a bulkhead separating said first expansion chamber from said second expansion chamber, said bulkhead having one or more openings extending through said bulkhead from said first expansion chamber to said second expansion chamber;

one or more internal baffle tubes positioned inside said housing in said exhaust gas flow path, said one or more internal baffle tubes each having a longitudinally extending outer wall extending through said one or more openings of said bulkhead, said longitudinally extending outer wall surrounding an acoustic lining located on an inner surface of said longitudinally extending outer wall, said acoustic lining extending through said one or more openings of said bulkhead, and a longitudinally extending perforated inner wall that is positioned inside said acoustic lining, said longitudinally extending perforated inner wall surrounding an open longitudinal flow passageway extending through said internal baffle tube, wherein said one or more internal baffle tubes extend a first distance into said first expansion chamber that is less than said longitudinal length of said first expansion chamber and a second distance into said second expansion chamber; and an outlet baffle tube having an upstream portion that extends into said second expansion chamber and a downstream portion that extends through said exhaust gas outlet, wherein said upstream portion is approximately four times said first distance.

10. The apparatus of claim 9 wherein said downstream portion extends outwardly from said housing.

11. The apparatus of claim 9 further comprising a catalyst disposed in a catalyst chamber in said housing, said catalyst chamber arranged in said exhaust gas flow path upstream of said first expansion chamber, wherein said exhaust gas inlet is a direct exhaust gas inlet for said catalyst chamber.

12. The apparatus of claim 11 wherein:

each of said one or more internal baffle tubes has an upstream portion which extends into said first expansion chamber the first distance;

said apparatus further comprises one or more first stage baffle tubes in said housing; and each of said one or more first stage baffle tubes has a first portion extending into said catalyst chamber and a second portion extending into said first expansion chamber, said second distance being approximately four times said second portion.

13. The apparatus of claim 12 wherein:

said exhaust gas inlet has a cross-sectional flow area and said one or more first stage baffle tubes have a total open cross-sectional flow area approximately equal to said cross sectional flow area of said exhaust gas inlet.

14. The apparatus of claim 9 wherein:

said apparatus further comprises a catalyst chamber in said housing in said exhaust gas flow path, said catalyst chamber having a longitudinal length D and said longitudinal length of said second expansion chamber is at least 1.60 times D.

15. The apparatus of claim 14 wherein:

said exhaust gas inlet has a cross-sectional flow area equal to an area of a circle having a diameter of A inches which is less than 10 inches;

said housing has a cross-sectional area equivalent to an area of a circle having a diameter of C inches; and C is a value in a range of from about (2.5(A−10)+40) to about (2.0(A−10)+50) inches.

16. The apparatus of claim 14 wherein:

said exhaust gas inlet has a cross-sectional flow area equal to an area of a circle having a diameter of A which is at least 10 inches;

said housing has a cross-sectional area equivalent to an area of a circle having a diameter of C inches; and C is a value in a range of from about (2.0(A−10)+40) to about (2.5(A−10)+45) inches.

17. The apparatus of claim 9 wherein said acoustic lining has a sound absorption coefficient of at least 0.99 for frequencies in octave bands extending from a 500 Hz octave band to an 8000 Hz octave band and a flow resistivity in a range of from about 10,000 to about 15,000 rayls per meter at standard temperature and pressure.

18. The apparatus of claim 9 wherein said acoustic lining is formed of mineral fiber, fiberglass, continuously woven fiber, meta-material, metal wool, expanding foam or steel wool.

19. A method for attenuating sound from an exhaust stream of an engine comprising providing a sound attenuating apparatus comprising:

a housing having an exhaust gas inlet and an exhaust gas outlet;

an exhaust gas flow path traveling through said housing from said exhaust gas inlet to said exhaust gas outlet;

a first expansion chamber in said housing, said first expansion chamber being in said exhaust gas flow path and said first expansion chamber having a longitudinal length;

a second expansion chamber in said housing, said second expansion chamber being downstream of said first expansion chamber in said exhaust gas flow path and said second expansion chamber having a longitudinal length, wherein said longitudinal length of said second expansion chamber is approximately four times said longitudinal length of said first expansion chamber;

a bulkhead separating said first expansion chamber from said second expansion chamber, said bulkhead having one or more openings extending through said bulkhead from said first expansion chamber to said second expansion chamber;

one or more internal baffle tubes in said exhaust gas flow path within said housing, said one or more internal baffle tubes each having a longitudinally extending outer wall extending through said one or more openings of said bulkhead, said longitudinally extending outer wall surrounding an acoustic lining located on an inner surface of said longitudinally extending outer wall, said acoustic lining extending through said one or more openings of said bulkhead, and a longitudinally extending perforated inner wall that is positioned inside said acoustic lining, said longitudinally extending perforated inner wall surrounding an open longitudinal flow passageway extending through said internal baffle tube, wherein said one or more internal baffle tubes extend a first distance into said first expansion chamber and a second distance into said second expansion chamber; and a first stage baffle tube extending a third distance into said first expansion chamber, wherein said second distance is approximately four times said third distance; and an outlet baffle tube extending a fourth distance into said second expansion chamber and through said exhaust gas outlet, wherein said fourth distance is approximately four times said first distance, and wherein said outlet baffle tube includes an acoustic lining along said fourth distance and through said exhaust gas outlet; and delivering the exhaust stream through said sound attenuating apparatus.

20. The method of claim 19 wherein said acoustic lining located on said inner surface of said one or more internal baffle tubes and said acoustic lining of said outlet baffle tube has a sound absorption coefficient of at least 0.99 for frequencies in octave bands extending from a 500 Hz octave band to an 8000 Hz octave band and a flow resistivity in a range of from about 10,000 to about 15,000 rayls per meter at standard temperature and pressure.

21. The method of claim 19 wherein said acoustic lining located on said inner surface of said one or more internal baffle tubes and said acoustic lining of said outlet baffle tube is formed of mineral fiber, fiberglass, continuously woven fiber, meta-material, metal wool, expanding foam or steel wool.

22. The method of claim 19 wherein said longitudinal length of said second expansion chamber is approximately equal to:

$(\lambda_0/2)*\ominus$ wherein $\lambda_0=C/f_0$, $f_0=\text{rpm}/60$, rpm=an operating speed of said engine in revolutions per minute, $$C=20.047(273.15+T_E)^{1/2},$$

$T_E$ is an exhaust temperature of said engine (° C.) at said rpm, and $\Theta$ is a value in a range of from about 6 to about 7.5.

23. The method of claim 19 wherein:

said sound attenuating apparatus comprises a catalyst chamber in said housing in said exhaust gas flow path, said catalyst chamber having a longitudinal length D and said longitudinal length of said second expansion chamber is at least 1.60 times D.

24. The method of claim 19 wherein:

said sound attenuating apparatus is connected to an exhaust discharge conduit of said engine;

said exhaust discharge conduit has a cross-sectional flow area equivalent to an area of a circle having a diameter of A inches, wherein A is at least 10 inches;

said housing has a cross-sectional area equivalent to an area of a circle having a diameter of C inches; and C is a value in a range of from about (2.0(A−10)+40) to about (2.5(A−10)+45) inches.

25. The method of claim 19 wherein:

said sound attenuating apparatus is connected to an exhaust discharge conduit of said engine;

said exhaust discharge conduit has a cross-sectional flow area equivalent to an area of a circle having a diameter of A inches, wherein A is less than 10 inches;

said housing has a cross-sectional area equivalent to an area of a circle having a diameter of C inches; and C is a value in a range of from about (2.5(A−10)+40) to about (2.0(A−10)+50) inches.

* * * * *